United States Patent [19]

Kalantar

[11] Patent Number: 5,004,473

[45] Date of Patent: Apr. 2, 1991

[54] SIMULATED NIPPLE FOR INFANTS

[75] Inventor: S. Javad Kalantar, Okemos, Mich.

[73] Assignee: Phyb U.S.A., Inc., Lansing, Mich.

[21] Appl. No.: 350,632

[22] Filed: May 11, 1989

[51] Int. Cl.[5] ..... A61J 17/00

[52] U.S. Cl. ..... 606/234; 215/11.1

[58] Field of Search ..... 128/359, 360; D24/45, D24/46; 215/11.1; 606/234,236

[56] References Cited

U.S. PATENT DOCUMENTS

| | | | |
|---|---|---|---|
| 3,924,621 | 12/1975 | Cassimally | 128/252 |
| 4,403,613 | 9/1983 | Panicci | 128/360 |
| 4,545,378 | 10/1985 | Chrones | 128/360 |
| 4,676,386 | 6/1987 | Phlaphongphanich | 128/360 |

FOREIGN PATENT DOCUMENTS

| | | | |
|---|---|---|---|
| 0530266 | 7/1957 | Belgium | 128/360 |
| 8603402 | 6/1986 | Int'l Pat. Institute | 128/360 |

*Primary Examiner*—C. Fred Rosenbaum
*Assistant Examiner*—William Lewis
*Attorney, Agent, or Firm*—Miller, Morriss and Pappas

[57] ABSTRACT

A simulated nipple which is integrally formed and having a special precision configuration in a hollowed manner forming a central cavity with a selectively positioned and configured throat portion in medical grade silicon rubber and including the manner of manufacture to provide precision created interior and exterior surfaces having a skin-like consistency and feel.

9 Claims, 1 Drawing Sheet

SIMULATED NIPPLE FOR INFANTS

The present invention relates to a simulated nipple in form for use in artificial breast feeding of infants and in the form of use for pacifiers and which nipples are markedly improved in structure and material to previously known devices of this general type and which nipples meet the current Consumer Protection Standards (U.S.A.) and are capable of high precision and high production manufacture permitting the economic use of medical grade silicone rubber.

The closest prior art devices known to the applicant are the devices described in the U.S. Letters Pat. No. 3,924,621 to K.A.I. Cassimally for Orthodontic Device. In that structure a nipple and pacifier is disclosed in which the hollow tip portion of the nipple is connected to a plurality of hollow connecting members which connecting members are in turn connected to a hollow base element and the spaced apart connecting members define milk delivery passages. The tongue of the infant extends forward and upward through the cavity between the connecting legs to tongue contact with the lingual surface of the maxillary incisors and the soft tissues immediately rearward of the maxillary incisors. In the pacifier form of Pat. No. 3,924,621 the hollow nipple tip is not perforated but is vented and a guard or shield, separate from the material of the hollow tip of the nipple, is provided.

By contrast, the present and improved structure is integral or unitary and is precision cast or molded from medical grade silicone rubber so that the interior surfaces are precision located and formed for uniform repetitive molding and stripping from an internal and precision dimensioned mandrel. The use of medical grade silicone was regarded as substantially impossible to provide in the previously known forms as in U.S. Pat. No. 3,924,621 using existing manufacture.

It has been the aim of manufacturers of pacifiers and nipples to seek a nipple that is supple, resilient, durable and preferably bio-compatible with the mouth environment of an infant in simulation of a mother's nipple. It is also considered desireable to provide a nipple which performs in such a manner as to exercise and develop the growing mouth in a manner acceptable and natural to the mandibular function and non-detrimental to the development of facial musculature and in gums, jaws and the precursor growth of teeth.

In achieving this objective, advices to the nipple industry caution against the application of forces which may unnaturally cause abnormal growth of tissue and teeth and which are negatively effective in the total formation of mouth, jaw, muscles, lips, bone and cartilage. These cautions in infancy are increasingly heralded as significant in the later development, facially and orthodontically, of the child. These admonitions have been heeded in the present nipples and the presently described structures are innovative in teaching the economic preparation of silicone rubber nipples as formed for nipples and nipple simulators. In the present invention the nipple simulator guides the tongue of the infant while providing a controlled resistance to the entire tongue backed by mandibular movement in simulation of the human nipple as engaged by-the infant under nursing conditions.

In addition to the provision of a new, useful and non-obvious nipple, the present invention is also directed to the method or procedure for manufacture of the new nipples.

Thus the principal object is to provide an improved nipple useful in connection with nursing bottles or nursing systems and pacifiers and to provide a procedure admitting use of a particular material, medical grade silicone rubber, in a way resulting in substantial economy and acceptance by the infants without the generation of undesireable stresses observable in prior nipple construction.

Other objects aimed at overall achievement of training and mouth development by nipples and pacifiers with performance to U.S.A. National Public Health standards or better will be further appreciated by those skilled in the art as the description proceeds.

Other objects including custom dimensioning of nipples to meet specific orthodontic challenges for improved facial and mouth development in infants and ease of infant acceptance of the nipple will be appreciated by those skilled in the art as the description proceeds.

IN THE DRAWINGS

Figure 7:
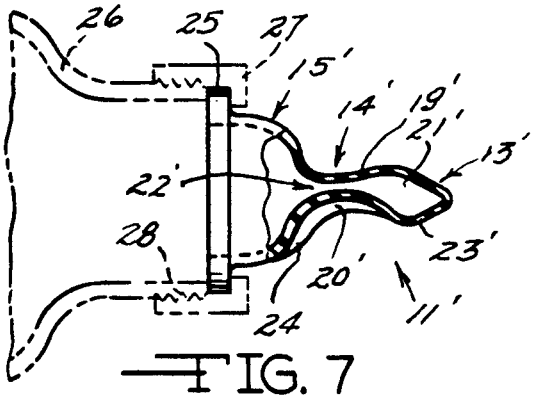

FIG. 7 is a side elevation view of a nipple construction in accord with the present invention for use with bottles or liquid containers and the bottle, threaded neck, and collar seal of the bottle securing the nipple in place. The view is partially cut away to reveal the concave depression as extended from the underside of the nipple and providing a hinge-like undercut means in the thin walled arcuate nipple base and complementing the traverse of the tongue of the infant to assist in achieving intermittent depression of the neck portion of the nipple while nursing.

GENERAL DESCRIPTION

In general the simulated nipple of the present invention presents a hollow structure in which all parts are integrally formed as by casting or molding over a mandrel extension so as to precision form and size the internal surfaces as well as the external surfaces and their relative spacing distance to achieve selective wall thicknesses in medical grade silicone rubber that are uniform and create a flesh-like "feel" with flesh-like resiliency to create a nipple which provides a tactile conformance to a mother's nipple. The new and unobvious nipple is created so as to be capable of repetitive high grade precision and includes connected transitional portions or zones. The outermost or front portion is the tip portion having an external bulbous appearance not unlike a disc in which the perimeter of the disc tapers to an abrupt rounded edge and the tip portion includes an enlarged storage cavity and is radially connected to a hollow throat portion. The hollow throat portion has a substantially flat upper surface and a lower surface which is concave and faired into the enlarged bulbous portion of the tip portion forming an arcuate bedded channel. The internal passage of the throat portion is arched upwardly toward the planar flat of the upper surface and the throat portion is relatively thin walled and may be selectively varied to customize the particular or desired sizing and resilience of the nipples of the present invention. The throat is integrally connected to the base portion of the nipple which may selectively be a shield structure flaring outwardly for pacifiers and as a dome-like arcuate hollow areolar shell in instances of nursing nipples as used with bottles and similar reservoirs of formula or other aqueous dispersions and solutions fed to infants.

The "feel" or tactile response of the described simulated nipples is a substantial advance toward manufacturing nipples that correspond to the mother's nipples. The arcuate accommodation for the tongue and the hinge-like suppleness of the nipple adjacent the throat portion provides a light selected resistance to the closure of the mandible and the attached frontal gum structure on the throat of the nipple in closure against the frontal gum structure of the upper jaw so that combination rearward movement of tongue and mandible achieve a valve-like closing entrapment and stripping of trapped liquid toward the nipple tip and emission through selected fluid delivery ports in the nipple.

The construction and manufacture of the described nipples also allows selective sizing of the nipples as to length in accommodation of various sized oral cavities while retaining the advantages of feel, of flow control from intermittent natural movement of facial and oral structure and for consequent attending oral-facial healthy growth.

It is also believed that by accommodation of the intermittent mandibular stripping, as described, that marked orthodontic progress can be experienced to the point of prescribing nipples and pacifiers to meet individual corrective requirements.

Literature reporting on the Orthodontic and oral-facial impact of simulated nipples is available with physiological parameters from:

The Institute of Malfunctions Therapy
1450 Madruga Avenue
Coral Gables, Fla. USA 33146 and
The Research Association for Oro Facial Muscle Imbalance, Inc.
of the same address.

SPECIFIC DESCRIPTION

Figure 1:
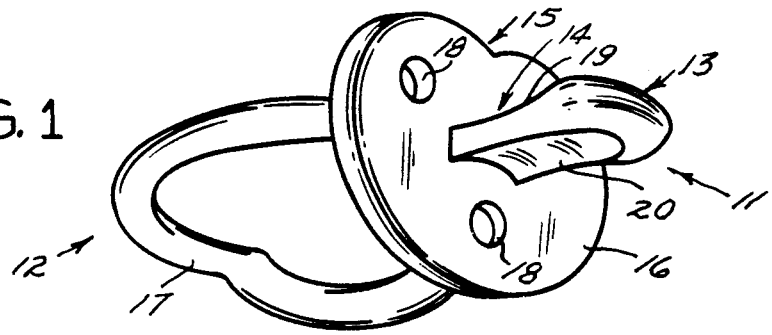
FIG. 1 is a perspective view of a simulated nipple in accord with the present invention and indicating the unitary or integrated nipple in a pacifier form.

Referring to the Drawings and with first reference to the FIG. 1 the nipple 11 of the present invention will be appreciated first as found in the pacifier structure form 12. The nipple 11 is definable in reference to the hollow nipple tip portion 13, the narrower and flatter hollow throat portion 14 connected radially to the tip portion 13 as a radial extension from the tip 13 and integrally connected thereafter to the arcuate flared base 15 shown in the shield or barrier 16 which surrounds the throat 14 in a transverse plane to the throat and having a thickness which imparts selective rigidity to the shield 16 preventing accidental ingestion by the infant. At the rearmost side of the shield 16 (side opposite the nipple tip portion 13) is a bail-like handle 17 integrally connected to the shield 16. The shield 16 includes plural openings 18 which are generally radially located in respect to the nipple 11 and through the shield 16 and serve as ventilation holes in prevention of any possible suffocation. The openings 18 and their disposition and the size and rigidity of the slightly concave-convex transverse shield 16 are in conformance with regulations imposed by Public Health and Safety Standards. The nipple 11 is hollow and the hollowness extends as will be seen through the throat 14 and base 15. Openings through the nipple 11 at the tip portion 13 may be provided as desired. The uppermost or top side (as shown) of the nipple 11 is truncated forming a relatively planar surface 19 slightly tilted from horizontal such that the upper wall of the cavity within the nipple 11 is substantially flat. The underside of the nipple 11 has a trench-like concavity 20 providing an arch or crown in the wall of the cavity within the nipple 11 and in the region of the throat portion 14 and that throat cavity, as will be later appreciated, extends through the base 15. The handle portion 17 in the pacifier construction 12 facilitates retrieval of the pacifier 12 and provides an added margin of safety with infant users.

The material forming the integrated nipple structure 11 and in the form of pacifier 12 is medical grade silicone rubber to achieve a suppleness as yet unavailable in nipple construction. An outer mold is provided which is precision finished and sized to outer skin specifications. The mold closes top to bottom with a parting line that splits the mold horizontally around the outer bulbous perimeter of the tip 13 around and over the base 15 and around the inside and outside of the handle 17 in definition of the external features of nipple 11 and the described pacifier structure 12. As will be appreciated the parting line of the mold is substantially a single plane. The mold, as described, closes on a precision formed mandrel externally configured to provide the precision internal cavity surfaces and precision located within the mold through the base 15 to establish (in spaced relation to the internal mold surfaces) the selected wall thicknesses necessary to the function of the nipple 11 in its tip 13 in its throat 14 and (in the pacifier form) to provide the selected rigidity in the shield 16. The silicone is injected after treatment of the molds and the silicone flows around the mandrel under requisite formulae temperature and pressure. The shot is cured in situ. The molds are opened and the part retained on the mandrel is stripped from the mandrel in a longitudinal direction and the process is repeated. Plural cavity molds and mandrels increase productivity. The ability to size molds and mandrels for specific rigidity, size and at selected Durometer limits for the particular run is readily appreciated by those skilled in the art.

Figure 2:
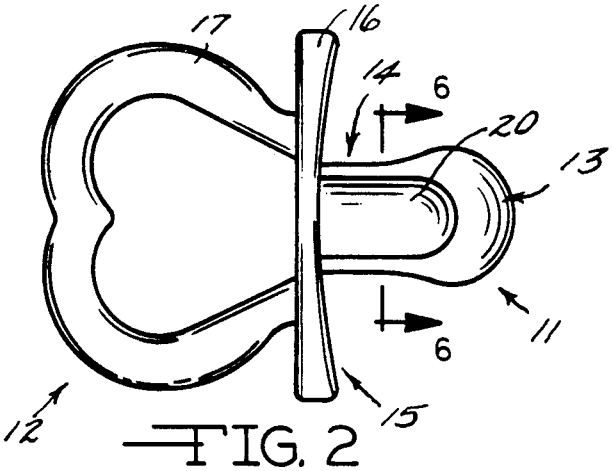
FIG. 2 is a bottom plan view of the nipple of the present invention as shown in FIG. 1.

FIG. 2 is a bottom plan view of the nipple structure 11 seen in FIG. 1 and especially locates the concavity 20 on the underside of the throat 14 as commencing in the bulbous tip portion 13 and continuing along the underside of the throat 14 to the base 15.

Figure 3:
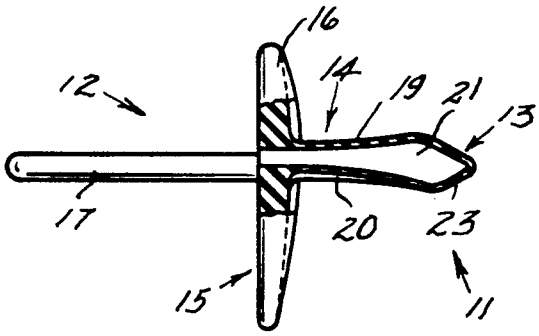
FIG. 3 is a partial cross section in a cut-away side elevation view of the nipple in FIGS. 1 and 2.

In the FIG. 3 the internal cavity 21 defined by the nipple 11 and including the concavity 20 on the underside of the nipple 11 is better understood and the planar upper surface 19 is visualized by the partial section through the nipple 11.

Figure 4:
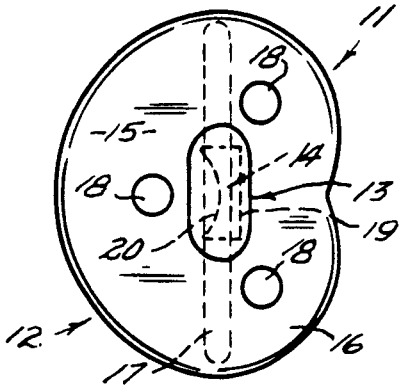
FIG. 4 is a front elevational view of the nipple seen in FIG. 2 and clearly showing the ventilation holes through the shield.

In FIG. 4 the front elevation from the nipple 11 side of the pacifier 12 reveals the bulbous tip portion 13 from a frontal position and describes the ovoid parameters. In phantom line the arched throat 14 is best configured with the substantially flat plane upper surface 19 and the concave underside surface 20 and which throat 14 can be visualized in phantom-line and in relation to the base 15 (shield or barrier guard 16) and handle 17 in the pacifier form 12. The perforations or openings 18 are also best appreciated as oriented through the 16.

Figure 5:
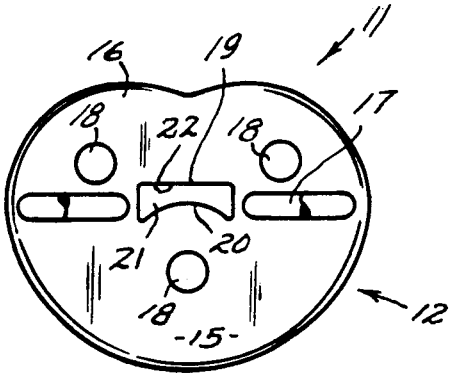
FIG. 5 is a rear elevation view of the nipple in FIG. 2 with a portion of the bail or handle of the pacifier structure cut away to reveal the internal cavity of the nipple at the barrier or shield portion.

In FIG. 5 the handle 17 has been partially cut away so that the passage 22 through the base 15 can best be seen as a continuation of the cavity 21 configured as an extension of the throat 14 by the cancavity 20 and the upper planar or flattened surface 19.

Figure 6:
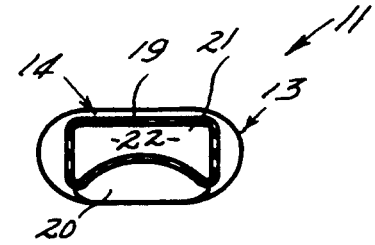
FIG. 6 is a somewhat enlarged cross sectional elevation view taken through the nipple on the line 6—6 of FIG. 2 and revealing the thin cross section of the medical grade silicone rubber material in the throat portion of the nipple and indicating the concavity of the lower side of the nipple throat.

By reference to FIG. 6 the cross section 6—6 through the throat portion 14 illustrates the relatively uniform thin wall throat portion 14 of the cavity 21 in the nipple 11.

In FIG. 7 a cut away profile view of a nursing bottle nipple 11' in accord with the present invention is illustrated and it will be appreciated that the bulbous tip portion 13', throat portion 14' and base 15' are somewhat modified but embody the features producing the internal cavity 21' corresponding to the cavity 21 in the pacifier form 12 and with the throat portion 14' configured substantially as throat 14 seen in the FIG. 6 by virtue of the planar upper wall 19' and the concavity 20' on the underside of the nipple 11' and with the added undercut extension 24 on the underside of the domed base 15' modified to accommodate the mandibular encounters as the upper and lower jaws and gum cartilage and precursor teeth close on the throat or neck portion 14 in a valve-like closing action where mouth and tongue collapse the throat 14' and movement of tongue and lower jaw strip the fluid in the cavity 21' toward the tip 13' of the nipple 11'. The nipple 11', is provided with selectively located delivery openings 23' in what the inventor regards as a preferred location assuming normal oral facial configuration. The method of preparation of the domed base version 15' of the nursing bottle nipple 11' is illustrated including the seal flange 25 which allows the nipple 11' to be secured to a bottle or feeding package 26 as by collar 27 employing the threads 28 or other well known sealing and fastening means.

The described structures are of the preferred embodiment of the nipple 11, 11'. The description includes a presentation of the preferred material comprising the nipple 11, 11' and the preferred method of manufacture providing the best and most precision manner of making the nipple devices pacifier 12 and nursing nipple 12'. The structures of the present invention and the methods described are operative and adaptable to prescription sizing and facilitate a completely new approach to stimulating proper oral facial development in infant feeding.

Having thus disclosed my invention and the preferred and operative forms thereof those skilled in the art will perceive changes, improvements and modifications within the skill of the art and it is the intention of the inventor that such changes, modifications and improvements be and are included in the spirit of the present invention limited only by my hereinafter appended claims.

I claim:

1. A simulated hollow nipple structure having an integral hollow tip portion, an integral hollow connecting throat portion and an integral expanded based portion characterized in that said tip portion is relatively bulbous, defining a terminal reservoir which opens rearwardly into said throat portion, said throat portion defining a throat passage with a cross section defined by a relatively flat upper surface and a concavo-convex undersurface externally arched forming an elongate inverted trench extending longitudinally of said nipple structure and in depression of said throat passage.

2. A simulated hollow nipple structure in accord with claim 1 wherein said nipple is formed from medical grade silicone rubber.

3. A simulated nipple in accord with claim 2 wherein said nipple includes variable thickness walls precision cast between an internal mandrel and an externally contoured spaced apart and precision surfaced and located mold.

4. A simulated nipple in accord with claim 3 removed from said mold upon opening and from said mandrel by stripping.

5. A simulated nipple in accord with claim 4 wherein said base portion forms a flared barrier guard extending transversely from said throat portion.

6. A simulated nipple in accord with claim 5 wherein said flared base forms an entry through said throat and to said tip portion of said nipple.

7. A simulated nipple in accord with claim 5 in which said base includes a bail-like handle integral with said base.

8. A simulated hollow nipple structure having an integral enlarged tip portion, a throat portion and an expanded base portion characterized in that: the throat portion defines a thin walled cavity between said tip and said base portions, said throat portion having a precision sized and surfaced interior and a concave-convex arched elongated trench-like undersurface and a substantially planar upper surface.

9. A simulated hollow nipple structure having an integral enlarged tip portion and a precision formed thin walled throat portion, an undersurface of said throat portion having an elongate convavo-convex trench-like depression and an expanded base portion integral with said tip portion and said throat portion and fabricated from medical grade silicone rubber by injection molding against a precision outer surface and against a precision-formed and located interior surface and said nipple structure removable by stripping.

* * * * *

UNITED STATES PATENT AND TRADEMARK OFFICE

CERTIFICATE OF CORRECTION

PATENT NO. : 5,004,473

DATED : 1991 April 2

INVENTOR(S) : S. Javad Kalantar

It is certified that error appears in the above—identified patent and that said Letters Patent is hereby corrected as shown below:

Abstract:

Change "silicon" to read --- silicone ---.

Col. 1, line 65, delete "-" (hyphen) between "by" and "the";

Col. 3, line 50, change "Malfunctions" to read --- Myofunctional ---;

Col. 5, line 8, before "16" insert --- shield ---;

Col. 6, line 44 change "concave" to read "concavo";

Col. 6, line 50 change "convavo" to read --- concavo ---.

Signed and Sealed this

Fourth Day of August, 1992

*Attest:*

DOUGLAS B. COMER

*Attesting Officer*

*Acting Commissioner of Patents and Trademarks*